US008531356B2

(12) United States Patent
Murata et al.

(10) Patent No.: US 8,531,356 B2
(45) Date of Patent: Sep. 10, 2013

(54) METHOD OF DRIVING A PLASMA DISPLAY PANEL TO COMPENSATE FOR THE INCREASE IN THE DISCHARGE DELAY TIME AS THE NUMBER OF SUSTAIN PULSES INCREASES

(75) Inventors: Mitsuhiro Murata, Hyogo (JP); Takuji Tsujita, Osaka (JP); Toshikazu Wakabayashi, Osaka (JP); Hiroshi Asano, Osaka (JP); Masaharu Terauchi, Hyogo (JP)

(73) Assignee: Panasonic Corporation, Osaka (JP)

( * ) Notice: Subject to any disclaimer, the term of this patent is extended or adjusted under 35 U.S.C. 154(b) by 321 days.

(21) Appl. No.: 12/596,527

(22) PCT Filed: Apr. 13, 2009

(86) PCT No.: PCT/JP2009/001687

§ 371 (c)(1),
(2), (4) Date: Oct. 19, 2009

(87) PCT Pub. No.: WO2009/128239

PCT Pub. Date: Oct. 22, 2009

(65) Prior Publication Data

US 2010/0109984 A1 May 6, 2010

(30) Foreign Application Priority Data

Apr. 15, 2008 (JP) ..... 2008-105421

(51) Int. Cl.
*G09G 3/28* (2013.01)
*H01J 17/49* (2012.01)

(52) U.S. Cl.
USPC ..... 345/71; 313/587

(58) Field of Classification Search
USPC ..... 345/60–72; 315/169.4; 313/581–587
See application file for complete search history.

(56) References Cited

U.S. PATENT DOCUMENTS 6,268,890 B1 7/2001 Kawahara
6,294,875 B1 * 9/2001 Kurata et al. ..... 315/169.1

(Continued)

FOREIGN PATENT DOCUMENTS

CN 1545688 11/2004
JP 10-319904 12/1998

(Continued)

OTHER PUBLICATIONS

International Search Report issued Jul. 14, 2009 in International (PCT) Application No. PCT/JP2009/001687.

*Primary Examiner* — Chanh Nguyen
*Assistant Examiner* — Navin Lingaraju
(74) *Attorney, Agent, or Firm* — Wenderoth, Lind & Ponack, L.L.P.

(57) ABSTRACT

In a plasma display panel, a protective layer of a front plate is formed of a base protective layer and a particle layer. The base protective layer is a thin film of metal oxide containing at least one of magnesium oxide, strontium oxide, calcium oxide, and barium oxide. The particle layer is formed in a manner that single-crystal particles of magnesium oxide having a peak of emission intensity at 200-300 nm two times or higher than another peak of emission intensity at 300-550 nm in the emission spectrum in cathode luminescence emission are stuck on the base protective layer. A panel driving circuit drives the plasma display panel with a subfield structure in which subfields are temporally disposed so that a magnitude of luminance weight has a monotonous decrease from a subfield where an all-cell initializing operation is performed to a subfield where a next all-cell initializing operation is performed.

3 Claims, 11 Drawing Sheets

(56) References Cited

U.S. PATENT DOCUMENTS

| | | | | |
|---|---|---|---|---|
| 6,404,411 | B1 * | 6/2002 | Masuda et al. | 345/66 |
| 6,501,446 | B1 * | 12/2002 | De Haan et al. | 345/63 |
| 2003/0218581 | A1 * | 11/2003 | Kawanami et al. | 345/60 |
| 2004/0032533 | A1 | 2/2004 | Correa | |
| 2005/0206318 | A1 * | 9/2005 | Hirota et al. | 313/585 |
| 2006/0284559 | A1 | 12/2006 | Naoi et al. | |
| 2008/0061692 | A1 * | 3/2008 | Miura et al. | 313/582 |
| 2008/0157671 | A1 * | 7/2008 | Naoi et al. | 313/586 |
| 2008/0157672 | A1 * | 7/2008 | Tsujita et al. | 313/586 |
| 2008/0157673 | A1 * | 7/2008 | Fukui et al. | 313/587 |
| 2009/0140652 | A1 | 6/2009 | Fukui et al. | |
| 2009/0146566 | A1 | 6/2009 | Fukui et al. | |

FOREIGN PATENT DOCUMENTS

| | | |
|---|---|---|
| JP | 11-52913 | 2/1999 |
| JP | 2006-54158 | 2/2006 |
| JP | 2006-147417 | 6/2006 |
| JP | 2006-251337 | 9/2006 |
| WO | 2007/139183 | 12/2007 |

* cited by examiner

METHOD OF DRIVING A PLASMA DISPLAY PANEL TO COMPENSATE FOR THE INCREASE IN THE DISCHARGE DELAY TIME AS THE NUMBER OF SUSTAIN PULSES INCREASES

This Application is a U.S. National Phase Application of PCT International Application PCT/JP2009/001687

TECHNICAL FIELD

The present invention relates to a plasma display device as an image display device using a plasma display panel.

BACKGROUND ART

Among thin-type image display elements, a plasma display panel (hereinafter simply referred to as a panel) has become practical as a large-screen display device from the advantage of high-speed display performance and easy upsizing.

A panel is formed of a front plate and a back plate attached with each other. The front plate has a glass substrate, display electrode pairs of scan electrodes and sustain electrodes disposed on the glass substrate, a dielectric layer formed so as to cover the display electrode pairs, and a protective layer disposed on the dielectric layer. The protective layer not only protects the dielectric layer from ion collision but also promotes generation of a discharge.

The back plate has a glass substrate, data electrodes formed on the glass substrate, a dielectric layer that covers the data electrodes, barrier ribs formed on the dielectric layer, and phosphor layers that emit light in red, green, and blue. The front plate and the back plate are oppositely disposed in a manner that the display electrode pairs and the data electrodes cross each other via a discharge space. The two plates are sealed at the peripheries with low-melting glass. The discharge space is filled with discharge gas including xenon. Discharge cells are formed at positions where the display electrode pairs face the data electrodes.

With a panel structured above, a plasma display device generates a gas discharge selectively in each discharge cell of the panel. Ultraviolet light generated at the discharge excites phosphors to emit light in red, green, and blue. Color image display is thus attained.

In a typical method for driving a panel, one field period is divided into a plurality of subfields, which is known as a subfield method. According to the subfield method, gradation display is attained by combination of the subfields to be lit. Each subfield has an initializing period, an address period and a sustain period. In the initializing period, a voltage is applied to the scan electrodes and the sustain electrodes to generate an initializing discharge. The initializing discharge generates wall charge on each electrode, which is necessary for an address operation in the subsequent address period. In the address period, scan pulses are sequentially applied to the scan electrodes, at the same time, address pulses are applied selectively to the data electrodes to generate an address discharge and to form wall charge. In the sustain period, sustain pulses are applied alternately to the display electrode pairs to generate a sustain discharge selectively in a discharge cell, by which the phosphor layers disposed in the discharge cells emit light for image display.

For obtaining higher quality of image, light-emitting control in discharge cells, i.e., which cells should be lit and which cells should not be lit, has to be done with reliability. That is, address operations should be properly completed within a predetermined period. To address above, manufacturers have been working on the development of a panel driven at a high-speed and seeking of improved driving method and driving circuits for providing high quality image so as to get best performance from the panel.

Discharge characteristics of a panel largely depend on the characteristics of a protective layer. In particular, the performance of electron emission and charge retention greatly affect the high-speed driving of a panel. To improve above, many studies on the material, structure, and manufacturing method for the protective layer have been made. For example, Patent Literature 1 discloses a plasma display panel with improvements in the panel and the electrode driving circuit. According to the disclosure, the panel has a magnesium oxide layer that exhibits a cathode luminescence emission peak at 200 to 300 nm. The magnesium oxide layer is generated through gas-phase oxidation of magnesium vapor. Besides, according to the electrode driving circuit above, scan pulses are sequentially applied to one of the display electrode pairs that constitute entire display lines, and at the same time, address pulses suitable for the display lines that undergo the application of scan pulses are applied to the data electrodes.

Recently, in addition to upsizing the screen, there has been growing demand for a high-definition plasma display device, such as a high-definition plasma display device with 1920 pixels×1080 lines and an extremely high-definition plasma display device with increased lines, for example, 2160 lines or 4320 lines; meanwhile, a sufficient number of subfields is necessary for smooth gradation display. Such a demanding situation requires the period for address operations per line to be further shortened. To complete address operations with reliability in a limited period, manufacturers are searching for an advanced panel with more reliable address operations at higher speed than before, a driving method thereof, and a plasma display device with driving circuits controllable the panel and suitable for the method.

[Patent Literature 1]Unexamined Japanese Patent Publication No. 2006-54158

SUMMARY OF THE INVENTION

The plasma display device of the present invention has a panel and a panel driving circuit. The panel contains a front plate, a back plate disposed opposite to the front plate, and discharge cells formed therebetween. The front plate has a first glass substrate, display electrode pairs formed on the first glass substrate, a dielectric layer formed so as to cover the display electrode pairs, and a protective layer formed on the dielectric layer. The back plate has a second glass substrate and data electrodes formed on the second glass substrate. The discharge cells are formed at which the display electrode pairs face the data electrodes. The panel driving circuit drives the panel in a manner that one field period is temporally divided into a plurality of subfields. Each of the subfields has an initializing period for generating an initializing discharge in the discharge cell, an address period for generating an address discharge, and a sustain period for generating a sustain discharge. The protective layer is formed of a base protective layer and a particle layer. The base protective layer is a thin film of metallic oxide including at least any one of magnesium oxide, strontium oxide, calcium oxide, and barium oxide. The particle layer is formed in a manner that single-crystal particles of magnesium oxide, which exhibit the peak of emission intensity of emission spectrum at 200-300 nm more than twice the peak of emission intensity at 300-550 nm, are stuck to the base protective layer. The panel driving circuit of the present invention drives the panel as follows. In an initializing period, the panel driving circuit carries out either one of the following two: an all-cell initializing operation in which an initializing discharge is generated in all of the discharge cells, and a selective initializing operation in which an initializing discharge is generated in a discharge cell having undergone a sustain discharge before the all-cell initializing operation. Besides, the subfields are temporally disposed in a manner that magnitude of luminance weight has monotonous decrease from a subfield where an all-cell initializing operation is carried out to a subfield disposed immediately before a subfield where the next all-cell initializing operation is carried out.

REFERENCE MARKS IN THE DRAWINGS

Figure 1:
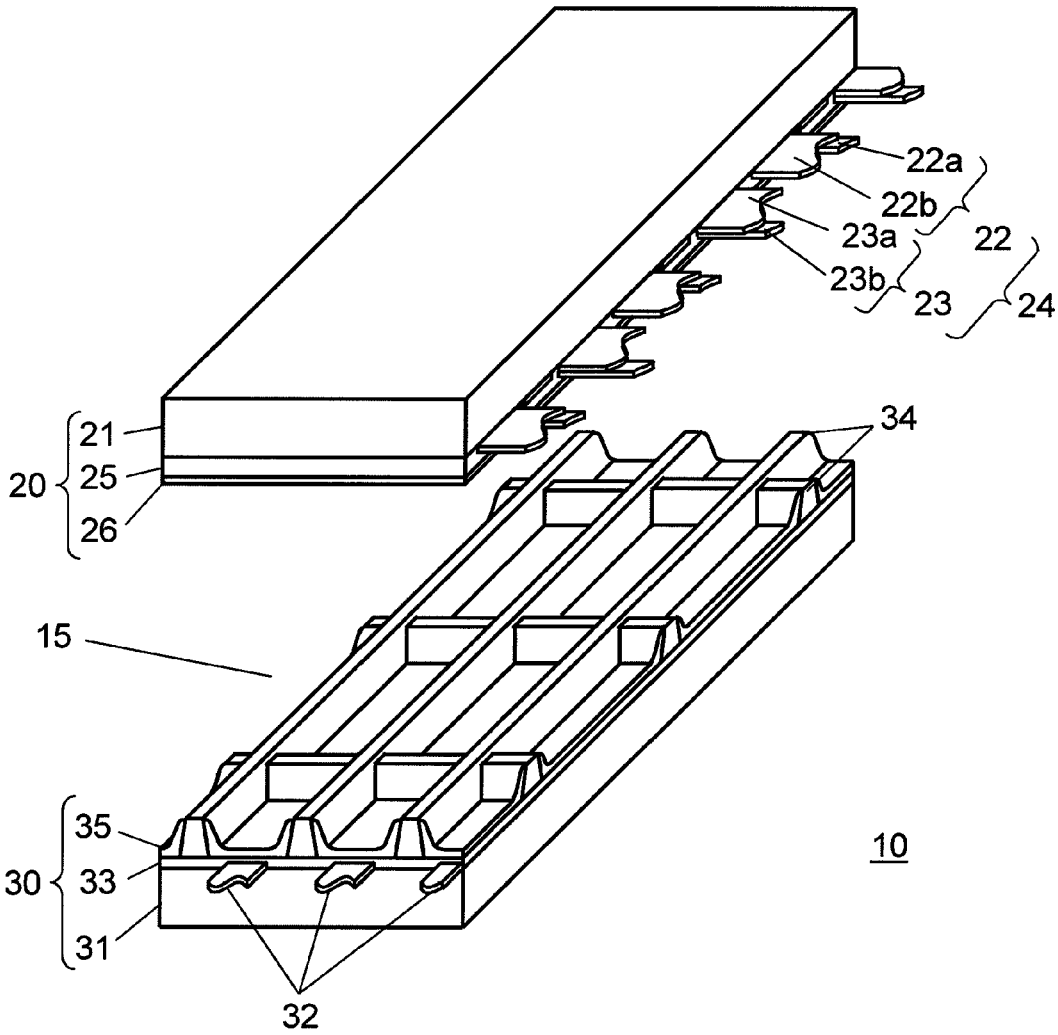
FIG. 1 is a perspective view of the structure of a panel in accordance with an exemplary embodiment of the present invention.

10 panel
20 front plate
21 (first) glass substrate
22 scan electrode
22*a*, 23*a* transparent electrode
22*b*, 23*b* bus electrode
23 sustain electrode
24 display electrode pair
25 dielectric layer
26 protective layer
26*a* base protective layer
26*b* particle layer
27 single-crystal particle
30 back plate
31 (second) glass substrate
32 data electrode
34 barrier rib
35 phosphor layer
41 image signal processing circuit
42 data electrode driving circuit
43 scan electrode driving circuit
44 sustain electrode driving circuit
45 timing generating circuit
50, 80 sustain pulse generating circuit
60 initializing waveform generating circuit
70 scan pulse generating circuit
100 plasma display device

DETAILED DESCRIPTION OF THE PREFERRED EMBODIMENTS

Hereinafter, a plasma display device of an exemplary embodiment of the present invention will be described with reference to the accompanying drawings.

First Exemplary Embodiment

FIG. 1 is a perspective view showing the structure of panel 10 in accordance with the exemplary embodiment of the present invention. Panel 10 has a structure in which front plate 20 is disposed opposite to back plate 30 and the two plates are sealed at the outer peripheries with sealing material of low-melting glass. Discharge space 15 inside panel 10 is filled with discharge gas of, for example, xenon, with a charged pressure of 400 to 600 Torr.

On glass substrate (first glass substrate) 21 of front plate 20, display electrode pairs formed of scan electrodes 22 and sustain electrodes 23 are disposed in parallel, and over which, dielectric layer 25 is formed so as to cover display electrode pairs 24. Protective layer 26 having magnesium oxide as a major component is formed on dielectric layer 25.

On glass substrate (second glass substrate) 31 of back plate 30, a plurality of data electrodes 32 are disposed in parallel in a direction orthogonal to display electrode pairs 24. Data electrodes 32 are covered with dielectric layer 33. Barrier ribs 34 are formed on dielectric layer 33. Phosphor layers 35, which emit light in red, green, and blue by ultraviolet light, are formed on dielectric layer 33 and on the side surface of barrier ribs 34. The discharge cells are formed at intersections of display electrode pairs 24 and data electrodes 32. A set of discharge cells having red, green, and blue phosphor layers 35 forms a pixel for color display. Dielectric layer 33 is not necessarily needed for the panel, and may be omitted from the structure of the panel.

Figure 2:
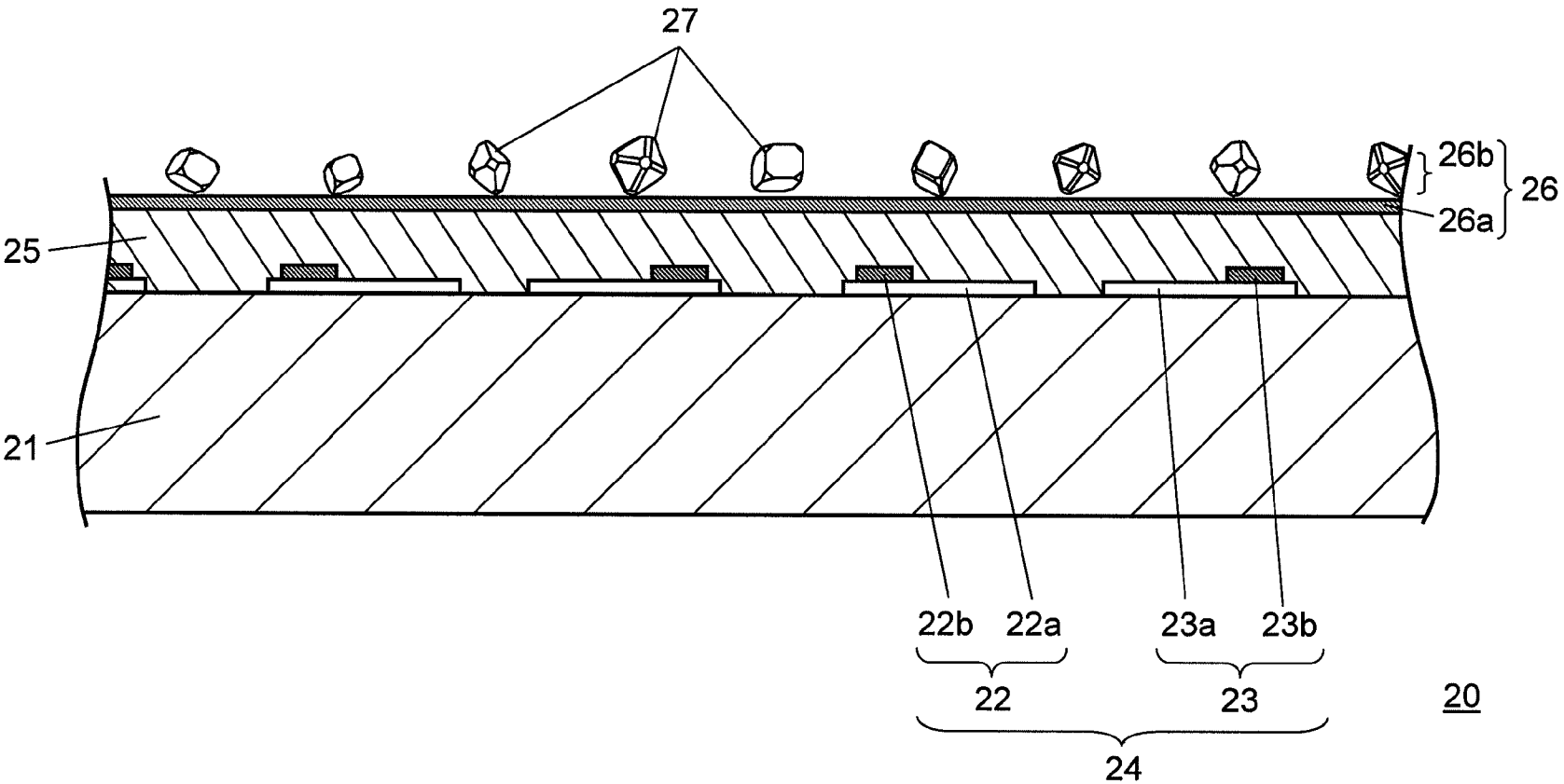
FIG. 2 is a sectional view of the structure of the front plate of the panel.

FIG. 2 is a section view showing the structure of front plate 20 of panel 10 in accordance with the exemplary embodiment of the present invention. FIG. 2 is an upside-down view of front plate 20 of FIG. 1. Display electrode pairs 24 formed of scan electrodes 22 and sustain electrodes 23 are formed on glass substrate 21. Each scan electrode 22 is formed of transparent electrode 22*a* and bus electrode 22*b* disposed on transparent electrode 22*a*. Transparent electrodes 22*a* are made of indium tin oxide, tin oxide, and the like. Similarly, each sustain electrode 23 is formed of transparent electrode 23*a* and bus electrode 23*b* disposed on transparent electrode 23*a*. Bus electrodes 22*b*, 23*b* are made of conductive material containing silver as a major component, which allows transparent electrodes 22*a*, 23*a* to have conductivity in its lengthwise direction.

Dielectric layer 25 is formed in a manner that low-melting glass containing lead oxide, bismuth oxide, or phosphorus oxide as a major component is applied by, for example, screen printing, die-coating and then fired. Protective layer 26 is formed on dielectric layer 25.

Protective layer 26 is formed on dielectric layer 25. Details on protective layer 26 will be described below. Protective layer 26 protects dielectric layer 25 from ion collision, at the same time, it enhances performance of electron emission and charge retention, which have a great influence on the driving speed of a panel. Protective layer 26 is formed of base protective layer 26*a* disposed on dielectric layer 25 and particle layer 26*b* on base protective layer 26*a*.

Base protective layer 26*a* is a magnesium oxide thin-film layer with a thickness of 0.3 to 1 μm formed by, for example, sputtering, ion-plating, and electron-beam deposition.

Particle layer 26*b*, which is formed by firing magnesium oxide precursor, has a structure where single-crystal particles 27 of magnesium oxide are stuck on base protective layer 26*a*. Single-crystal particle 27 has a relatively uniform particle-size distribution with an average particle diameter of 0.3 to 4 μm. Single-crystal particles 27 are not necessarily disposed over the entire surface of base protective layer 26*a*; island-shaped distribution with a covering ratio of 1% to 30% is effective enough. Although single-crystal particle 27 is basically shaped into a regular hexahedron or regular octahedron, some differences from variations caused in the manufacturing process are allowable. Besides, particle 27 may have a shape, with a vertex of the hexahedron or the octahedron truncated, or may have a shape with an rhombic plane appeared on a ridge line as a result of cutting off the ridge line.

In this way, protective layer 26 is formed of base protective layer 26*a* and particle layer 26*b* disposed on base protective layer 26*a*. The structure allows panel 10 to have excellent protective layer 26 with high performance of electron emission and charge retention.

Figure 3:
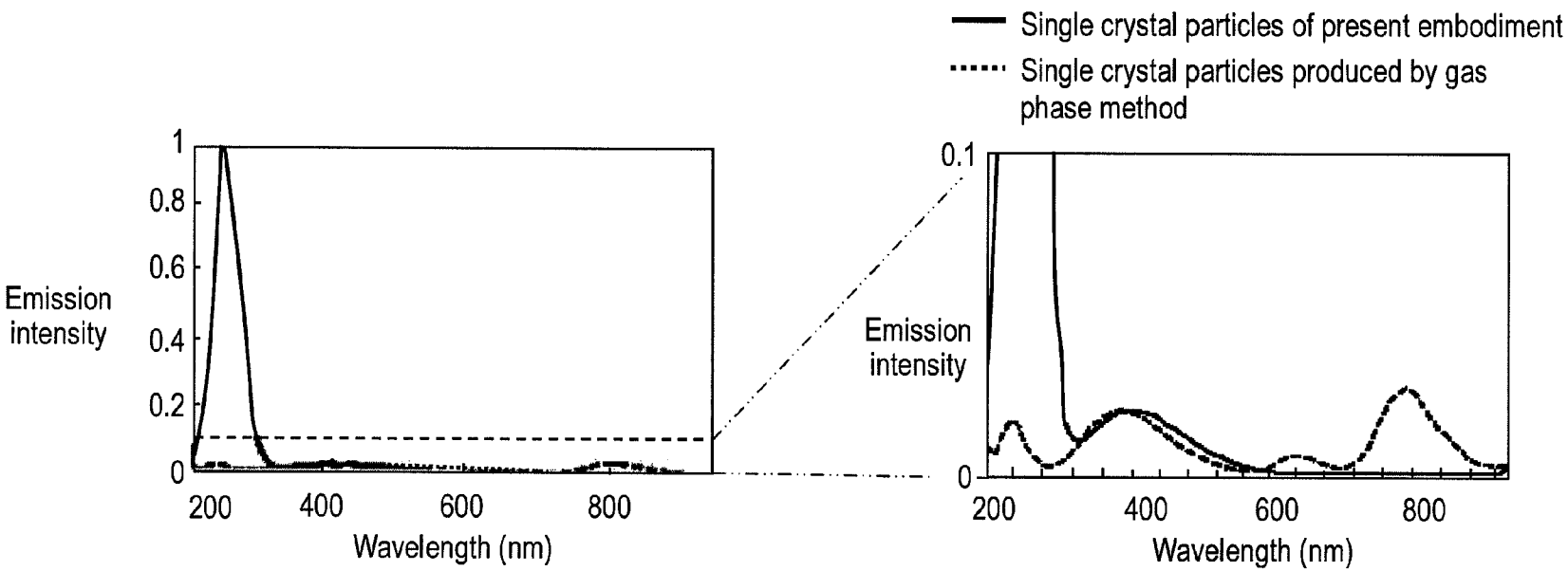
FIG. 3 shows emission spectrum of a single-crystal particle used for the panel.

From a study on cathode luminescence emission of a single-crystal particle, the inventors have found that an evaluation of characteristics of the single-crystal particle, in particular, electron emission performance is evaluated by an emission spectrum. FIG. 3 shows an emission spectrum of single-crystal particle 27 used for the panel of the embodiment of the present invention. For comparison purposes, FIG. 3 also shows an emission spectrum of single-crystal particles of magnesium oxide formed on a base protective layer by gas-phase oxidation. The emission spectrum of single-crystal particle 27 exhibits a large peak of emission intensity at 200-300 nm and a small peak thereof at 300-550 nm. On the other hand, according to the emission spectrum of the single-crystal particle formed by gas-phase oxidation, the peaks at 200-300 nm and 300-550 nm are both small.

Figure 4:
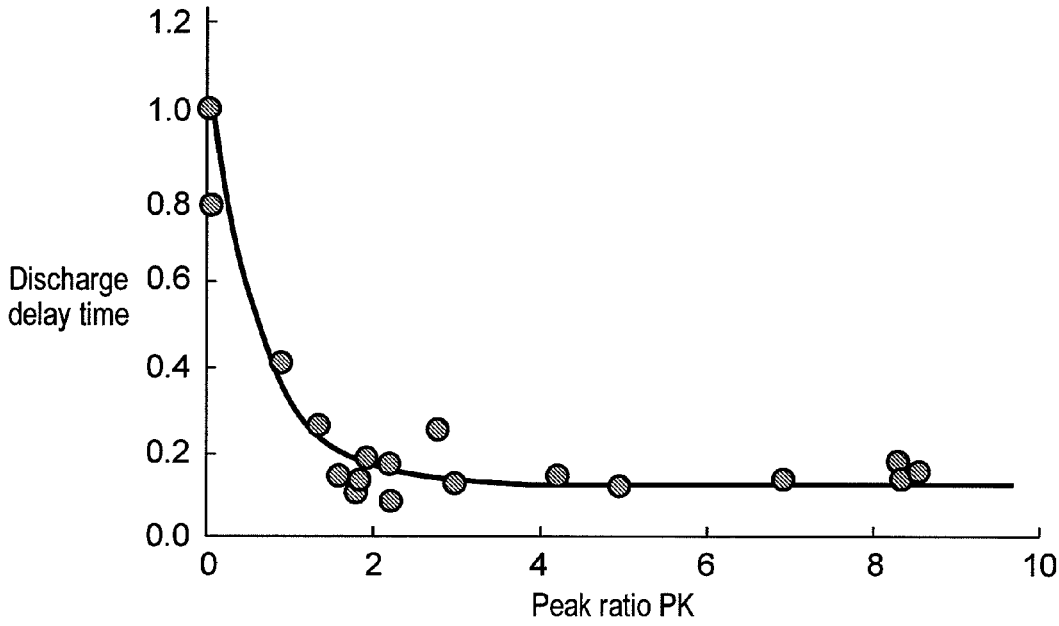
FIG. 4 shows the relation between a discharge delay time and a peak ratio of the emission spectrum of the single-crystal particle used for the panel.

Focusing attention on the two peaks of emission intensity, the inventors have looked at the relation between electron emission performance and the ratio of a peak of emission intensity (hereinafter, simply as peak ratio PK) at 200-300 nm to another peak of emission intensity at 300-550 nm. Specifically, the inventors have prepared panels with different values of peak ratio PK as a prototype and measured discharge delay time of them. FIG. 4 shows the relation between discharge delay time Td and peak ratio PK of the emission spectrum of single-crystal particle 27 employed for the panel of the embodiment of the present invention. The horizontal axis represents peak ratio PK. Peak ratio PK is determined by calculating the ratio of the integration value of an emission spectrum in the range of 200 nm or greater and less than 300 nm to the integration value of an emission spectrum at 300 nm or greater and less than 550 nm. The vertical axis represents discharge delay time as value TS normalized with respect to the discharge delay time calculated when peak ratio PK takes nearly zero. That is, a panel having smaller TS exhibits excellent electron emission. When the value of peak ratio PK of the emission spectrum takes 2 or more, i.e., the peak of emission intensity at 200-300 nm is at least twice the peak of emission intensity at 300-550 nm, normalized discharge delay time TS is constantly kept at below 0.2, which shows excellent electron emission.

Although the measurement by the inventors does not establish an obvious correlation between peak ratio PK of the emission spectrum and electron emission performance, it leads to the consideration below. That is, the peak of the emission spectrum at 200-300 nm shows the presence of a relaxation process of energy of an amount of approx. 5 eV. This indicates a high probability of occurrence of Auger electron emission that accompanies with the large amount of energy relaxation. On the other hand, the peak of the emission spectrum at 300-550 nm shows that there are many trap levels between bandgaps, which are caused, for example, by oxygen deficiency. It seems hard to generate the relaxation process of a large amount of energy and therefore Auger electron emission has low probability of occurrence. That is, having a higher peak at 200-300 nm and a lower peak at 300-550 nm allows a single-crystal particle to promote electron emission. Therefore, employing single-crystal particle 27 with characteristic above for particle layer 26*b* contributes to a panel with high electron emission.

Single-crystal particle 27 with a high peak in the emission spectrum at 200-300 nm and with a low peak at 300-550 nm can be created by a liquid phase method. Specifically, magnesium hydroxide, which is a precursor of magnesium oxide, is evenly fired in an oxygen-containing atmosphere at high temperatures, as described below.

(Liquid Phase Method 1)

An aqueous solution of magnesium alkoxide or magnesium acetylacetone of a purity greater than 99.95% is prepared. A little amount of acid is added to the solution and the solution is hydrolyzed. Through the hydrolysis, magnesium hydroxide gel is obtained. The gel is dehydrated by firing in air, by which powder of single-crystal particle 27 is obtained.

(Liquid Phase Method 2)

An aqueous solution of magnesium nitrate of a purity greater than 99. 95% is prepared. An alkali solution is added to the solution of magnesium nitrate so that magnesium hydroxide is precipitated. After separated from the solution, the precipitate of magnesium hydroxide is dehydrated by firing in air, by which powder of single-crystal particle 27 is obtained.

(Liquid Phase Method 3)

An aqueous solution of magnesium chloride of a purity greater than 99. 95% is prepared. Calcium hydroxide is added so that magnesium hydroxide is precipitated. After separated from the solution, the precipitate of magnesium hydroxide is dehydrated by firing in air, by which powder of single-crystal particle 27 is obtained.

Throughout the methods above, the firing temperature should preferably be 700° C. or higher, more preferably, 1000° C. or higher. A single-crystal particle fired at a temperature lower than 700° C. has an immature crystal face, forming a defective structure.

The experiment by the inventors has found that when magnesium hydroxide is fired at temperatures of 700° C. or higher and lower than 2000° C., two types of single-crystal particle are formed: one is the single-crystal particle with a peak ratio PK of 1 or more, and the other is the single-crystal particle that has a peak ratio PK of less than 1 and has a noticeable peak in the emission spectrum at 680-900 nm. Further, the firing process at a temperature of 1400° C. or more increases the rate of forming the latter type of the single-crystal particle, i.e., having a peak ratio PK of less than 1 and a noticeable peak in the emission spectrum at 680-900 nm. Therefore, for increasing the rate of forming magnesium-oxide single-crystal with a peak ratio of 1 or more, the firing temperature should preferably be 700° C. or higher and lower than 1400° C.

Instead of magnesium hydroxide above, more than one of the followings can be employed for a magnesium-oxide precursor: magnesium alkoxide, magnesium acetylacetone, magnesium nitrate, magnesium chloride, magnesium carbonate, magnesium sulfate, magnesium oxalate, and magnesium acetate. The purity of a magnesium compound as the magnesium-oxide precursor should preferably be greater than 99.95%, more preferably, greater than 99.98%. This is because having a large amount of impurity element, such as alkali metals, boron, silicon, iron, aluminum, in the precursor invites sintering or fusion bonding between the particles in the firing process, resulting in immature growth of crystalline structure.

The magnesium-oxide single-crystal particle that has peak ratio PK less than 1 and has a peak in the spectrum at 680-900 nm tends to have a particle diameter smaller than that of magnesium-oxide single-crystal particle with peak ratio PK of 1 or greater. Therefore, the two types of magnesium-oxide single-crystal particle can be separated from each other by classification, by which a desired single-crystal particle with greater peak ratio PK is sorted out.

As described above, particle layer 26*b* of the embodiment has a structure where single-crystal particle 27, which has the peak in the emission spectrum at 200-300 nm being at least twice the peak at 300-550 nm, is stuck on base protective layer 26*a*. Such structured particle layer 26*b* offers stable and high performance both in electron emission and charge retention, allowing panel 10 to be driven at a high speed.

Next will be described a method for driving panel 10 of the embodiment of the present invention.

Figure 5:
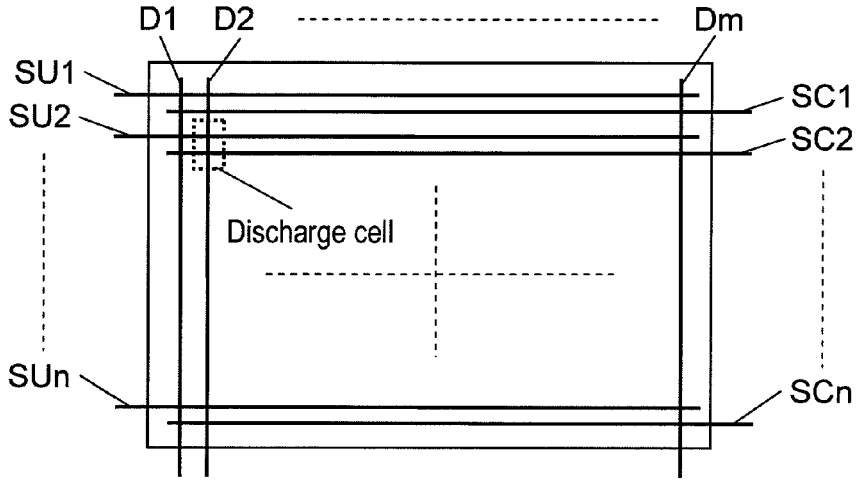
FIG. 5 shows an electrode array of the panel.

FIG. 5 shows an electrode array of panel 10 in accordance with the embodiment of the present invention. In a row (line) direction, panel 10 has n long scan electrodes SC1 through SCn (corresponding to scan electrodes 22 in FIG. 1) and n long sustain electrodes SU1 through SUn (corresponding to sustain electrodes 23 in FIG. 1). In a column direction, panel 10 has m long data electrodes D1 through Dm (corresponding to data electrodes 32 in FIG. 1). A discharge cell is formed at an intersection of a pair of scan electrode SCi and sustain electrode SUi (where, i is 1 through n) and data electrode Dj (where, j is 1 through m). That is, panel 10 contains m×n discharge cells in the discharge space. When the panel is used in a high-definition plasma display device, for example, m=1920×3=5760 and n=1080.

Next will be described waveforms of driving voltage applied to each electrode for driving panel 10.

Panel 10 employs a subfield method to provide gradation display. In the subfield method, one field period is divided into a plurality of subfields. Light-emitting control of the discharge cells is carried out on a subfield basis. Each subfield has an initializing period, an address period, and a sustain period.

In the initializing period, an initializing discharge is generated to form wall charge on each electrode required for a subsequent address discharge. Initializing operations in the initializing period have two types: one is for generating the initializing discharge in all of the discharge cells (hereinafter, an all-cell initializing operation) and the other is for generating the initializing discharge selectively in a discharge cell having undergone a sustain discharge in the sustain period in the immediately preceding subfield (hereinafter, a selective initializing operation).

In the address period, an address discharge is generated selectively in a discharge cell to be lit to form wall charge. In the sustain period, sustain pulses corresponding in number to each luminance weight are alternately applied to the display electrode pairs so that a sustain discharge is generated in the discharge cell having undergone an address discharge. Detailed description on the subfield structure will be given later, and the waveforms of driving voltage and the workings thereof are described hereinafter.

Figure 6:
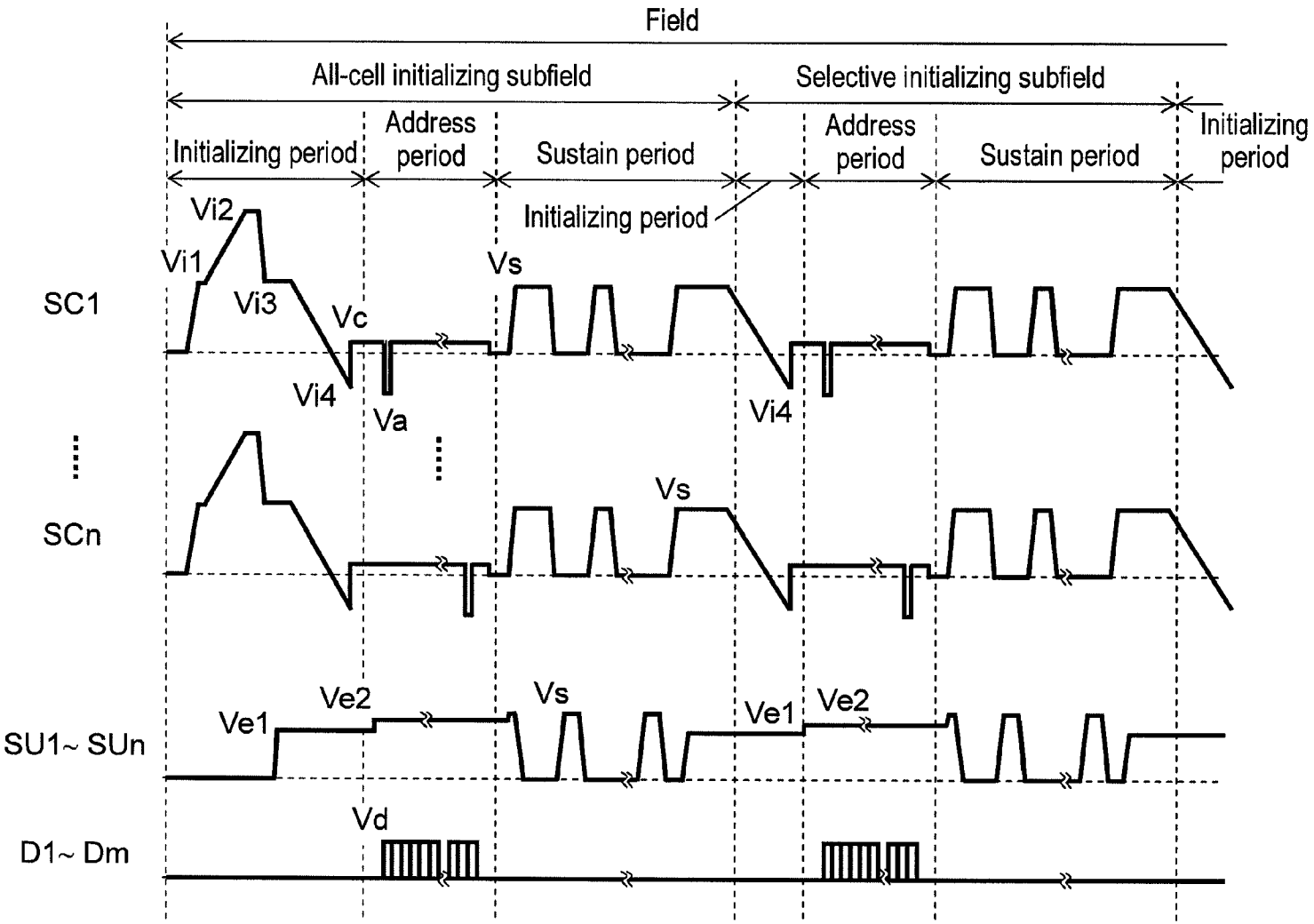
FIG. 6 is a waveform chart of driving voltage applied to each electrode of the panel.

FIG. 6 shows a waveform chart of driving voltage applied to each electrode of panel 10 of the embodiment of the present invention. FIG. 6 shows two subfields; one carries out the all-cell initializing operation, and the other carries out the selective initializing operation.

First will be described the subfield (the all-cell initializing subfield) that carries out the all-cell initializing operation.

In the first half of the initializing period, 0 (V) is applied to data electrodes D1 through Dm and sustain electrodes SU1 through SUn, and a ramp waveform voltage is applied to scan electrodes SC1 through SCn. The ramp waveform voltage gradually increases, starting from voltage Vi1—that is lower than the discharge start voltage with respect to sustain electrodes SU1 through SUn—toward voltage V12 that exceeds the discharge start voltage.

During the application of the up-ramp voltage, a weak initializing discharge occurs between scan electrodes SC1 through SCn and sustain electrodes SU1 through SUn, and between scan electrodes SC1 through SCn and data electrodes D1 through Dm. Through the initializing discharge, negative wall voltage is accumulated on scan electrodes SC1 through SCn, and positive wall voltage is accumulated on data electrodes D1 through Dm and sustain electrodes SU1 through SUn. Here, the wall voltage on each electrode represents the voltage generated by wall charge accumulated, for example, on the dielectric layer, the protective layer, and the phosphor layer disposed over the electrodes. In the initializing discharge above, an excessive amount of wall charge is accumulated prior to the subsequent latter half of the initializing period where wall voltage is optimized to a proper value.

In the latter half of the initializing period, voltage Ve1 is applied to sustain electrodes SU1 through SUn, and a ramp waveform voltage is applied to scan electrodes SC1 through SCn. The ramp waveform voltage gradually decreases, starting from voltage Vi3—that is lower the discharge start voltage with respect to sustain electrodes SU1 through SUn—toward voltage V14 that exceeds the discharge start voltage. During the application of the down-ramp voltage, a weak initializing discharge between scan electrodes SC1 through SCn and sustain electrodes SU1 through SUn, and between scan electrodes SC1 through SCn and data electrodes D1 through Dm. Through the discharge, negative wall voltage on scan electrodes SC1 through SCn and positive wall voltage on sustain electrodes SU1 through SUn are weakened, on the other hand, positive wall voltage on data electrodes D1 through Dm is adjusted to a value suitable for the address operation. In this way, the all-cell initializing operation for generating an initializing discharge in all the discharge cells is completed.

In the subsequent address period, voltage Vet is applied to sustain electrodes SU1 through SUn, and voltage Vc is applied to scan electrodes SC1 through SCn.

Next, negative scan pulse voltage Va is applied to scan electrode SC1 located in the first line, and positive address pulse voltage Vd is applied to data electrode Dk (k is 1 through m), which corresponds to the discharge cell to be lit in the first line. At this time, difference in voltage at the intersection of data electrode Dk and scan electrode SC1 is calculated by adding the difference in wall voltage between data electrode Dk and scan electrode SC1 to the difference in voltage applied from outside (i.e., Vd−Va). The calculated value exceeds the discharge start voltage, thereby generating an address discharge between data electrode Dk and scan electrode SC1, and between sustain electrode SU1 and scan electrode SC1. Through the address discharge, positive wall voltage is accumulated on scan electrode SC1 and negative wall voltage is accumulated on sustain electrode SU1 and data electrode Dk.

In the process above, the time that has elapsed since application of scan pulse voltage Va and address pulse voltage Vd before an address discharge is referred to as a "discharge delay time". For example, if a panel offers poor electron emission and accordingly the discharge delay time of the panel increases, there is a necessity to extend the time required for the application of scan pulse voltage Va and address pulse voltage Vd so as to complete an address operation without failure. That is, the scan pulse and the address pulse need a longer pulse width, increasing the time required for an address operation. Similarly, if a panel offers poor charge retention, there is a necessity to increase each voltage value of scan pulse voltage Va and address pulse voltage Vd so as to compensate for decrease in wall voltage. However, panel 10 of the embodiment offers high electron emission, allowing pulse widths of the scan pulse and the address pulse to be shorter than those in a conventional panel. This contributes to a reliable address operation at high speed. Besides, panel 10 of the embodiment offers high charge retention, allowing voltage values of scan pulse voltage Va and address pulse voltage Vd to be smaller than those in a conventional panel.

In an address operation, as described above, an address discharge is generated so as to accumulate wall voltage on each electrode in the discharge cell to be lit in the first line. On the other hand, the voltage at the intersections of scan electrode SC1 and data electrodes D1 through Dm with no application of address pulse voltage Vd is lower than the discharge start voltage and therefore no address discharge. After the address operation is repeatedly carried out until the discharge cells located in the n-th line, the address period is completed.

In the subsequent sustain period, positive sustain pulse voltage Vs is applied to scan electrodes SC1 through SCn, and 0 (V) is applied to sustain electrodes SU1 through SUn. In the discharge cell having undergone an address discharge, difference in voltage between scan electrode SCi and sustain electrode SUi is calculated by adding sustain pulse voltage Vs to the difference between the wall voltage on scan electrode SCi and the wall voltage on sustain electrode SUi. The calculated value exceeds the discharge start voltage, thereby generating a sustain discharge between scan electrode SCi and sustain electrode SUi. The sustain discharge produces ultraviolet light, allowing phosphor layer 35 to emit light. Negative wall voltage is accumulated on scan electrode SCi and positive wall voltage is accumulated on sustain electrode SUi and data electrode Dk. A discharge cell without an address discharge in the address period has no sustain discharge and therefore maintains the wall voltage the same as that at the end of the initializing period.

Subsequently, 0 (V) is applied to scan electrodes SC1 through SCn, and sustain pulse voltage Vs is applied to sustain electrodes SU1 through SUn. In the discharge cell having undergone a sustain discharge, difference in voltage between sustain electrode SUi and scan electrode SCi exceeds the discharge start voltage, thereby generating a sustain discharge again between sustain electrode SUi and scan electrode SCi. Through the discharge, negative wall voltage is accumulated on sustain electrode SUi and positive wall voltage is accumulated on scan electrode SCi. Similarly, sustain pulses corresponding in number to each luminance weight are applied alternately to scan electrodes SC1 through SCn and sustain electrodes SU1 through SUn to apply potential difference between the electrodes of the display electrode pairs. This allows the sustain discharge to repeatedly occur in a discharge cell having undergone an address discharge in the address period.

At the end of the sustain period, a voltage difference with a narrow-width-pulse shape or a potential difference with a ramp waveform is applied between scan electrodes SC1 through SCn and sustain electrodes SU1 through SUn. The application of voltage erases wall voltage on scan electrode SCi and sustain electrode SUi, with the positive wall voltage on data electrode Dk maintained.

Next will be described the workings of the sub-field (the selective initializing subfield) that carries out a selective initializing operation. In the selective initializing operation of the initializing period, voltage Ve1 is applied to sustain electrodes SU1 through SUn, and 0 (V) is applied to data electrodes D1 through Dm. A ramp voltage gradually decreasing toward voltage Vi4 is applied to scan electrodes SC1 through SCn. In the discharge cell having undergone a sustain discharge in the sustain period in the previous subfield, a weak initializing discharge occurs. The discharge weakens wall voltage on scan electrode SCi and sustain electrode SUi. A sufficient amount of positive wall voltage has been accumulated on electrode Dk by an immediately preceding sustain discharge. The surplus amount of the wall voltage is discharged, so that a proper amount of wall voltage is left for the address operation.

On the other hand, a discharge cell without a sustain discharge in the previous subfield has no initializing discharge and therefore maintains the wall voltage the same as that at the end of the initializing period of the previous subfield. As described above, the selective initializing operation is selectively carried out in a discharge cell having undergone the sustain operation in the sustain period of the immediately preceding subfield.

The operations of address period of the selective-cell initializing subfield are similar to those of the all-cell initializing subfield and descriptions thereof will be omitted. The operations of the subsequent sustain period are also similar to those of the all-cell initializing subfield except for the number of sustain pulses.

Next will be described the subfield structure employed for the driving method of the embodiment. The distinctive feature of the driving method of the embodiment is that the subfields are temporally disposed in a manner that magnitude of luminance weight has monotonous decrease from an all-cell initializing subfield and to a subfield disposed immediately before the next all-cell initializing subfield. That is, a selective initializing subfield that follows an all-cell initializing subfield has a luminance weight equal to or smaller than that of the immediately preceding subfield, and similarly, a selective initializing subfield that follows the aforementioned selective initializing subfield has a luminance weight equal to or smaller than that of the immediately preceding subfield. Hereinafter, the aforementioned subfield structure where magnitude of luminance weight has monotonous decrease between an all-cell initializing subfield and a subfield disposed immediately before the next all-cell initializing subfield will be simply referred to "descending coding".

Figure 7:
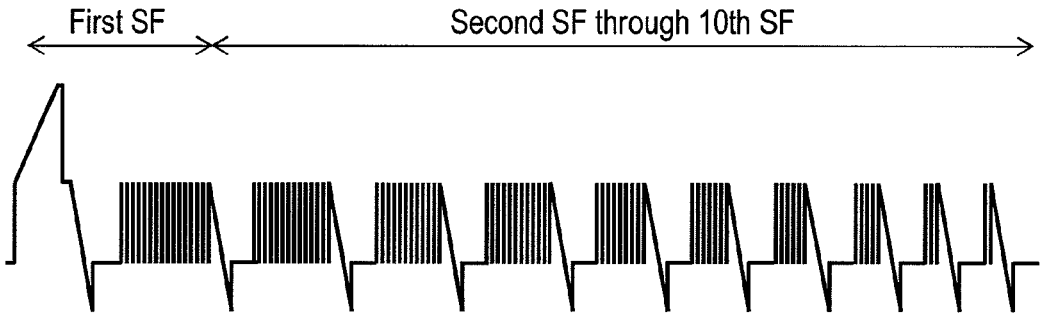
FIG. 7 shows the structure of the subfields in accordance with the exemplary embodiment of the present invention.

FIG. 7 shows the subfield structure in accordance with the exemplary embodiment of the present invention. In the structure of the embodiment, one field is divided into 10 subfields (first SF, second SF, . . . , 10th subfield) and the subfields have luminance weights of 80, 60, 44, 30, 18, 11, 6, 3, 2, and 1. The first SF is an all-cell initializing subfield, and the second SF through 10th subfields are selective initializing subfields. FIG. 7 schematically shows the waveform of the driving voltage to be applied to scan electrodes 22 for one field. The detail of the driving voltage waveform in each period of each subfield is shown in FIG. 6.

In the embodiment, panel 10 is driven with the subfield structure of descending coding. Driving a panel with descending coding enhances the speed and stability of an address operation, getting the best performance from panel 10 capable of high-speed driving. This provides the plasma display panel with high quality of image display. Besides, the driving with descending coding further reduces address pulse voltage, and accordingly, reducing the power consumption of the plasma display device.

The reason will be described hereinafter. The inventors have measured the discharge delay time of panel 10 of the present invention. The measured panel is the panel of the present invention, which has protective layer 26 formed of base protective layer 26*a* and particle layer 26*b*. Particle layer 26*b* is formed in a manner that single-crystal particles 27 are stuck on base protective layer 26*a* so as to have almost uniform distribution over the entire surface of base protective layer 26*a*. Single-crystal particle 27 has the peak in emission spectrum at 200-300 nm being twice or grater than the peak at 300-550 nm. The panel is a 42-inch panel of high luminance and high definition and employs 100% xenon gas as discharge gas. For comparison, the discharge delay time has been measured on a conventional panel having base protective layer 26*a* only, that is, without particle layer 26*b*.

The measurement on the discharge delay time of an address discharge is carried out in a discharge cell controlled so that the discharge cell has no influence of a discharge generated in the surrounding discharge cells and an address discharge is not generated in the adjacent discharge cells. The discharge delay time is affected by a phosphor material. In the measurement, the discharge delay time is measured in a discharge cell coated with green phosphor that has a tendency to increase the discharge delay time.

To find the relation between the discharge delay time and a lapse of time since the all-cell initializing operation, the inventors has measured the discharge delay time when the address operation is carried out in only one subfield of the first SF through the 10th SF. The number of sustain pulses in the measurement is set at two for all the subfields. To obtain the relation between the discharge delay time and the number of sustain pulses, the address operation is carried out only in the fifth SF, and thereafter, the discharge delay time is measured while the number of sustain pulses in the subsequent sustain period is being varied from 2 to 256.

Figure 8A:
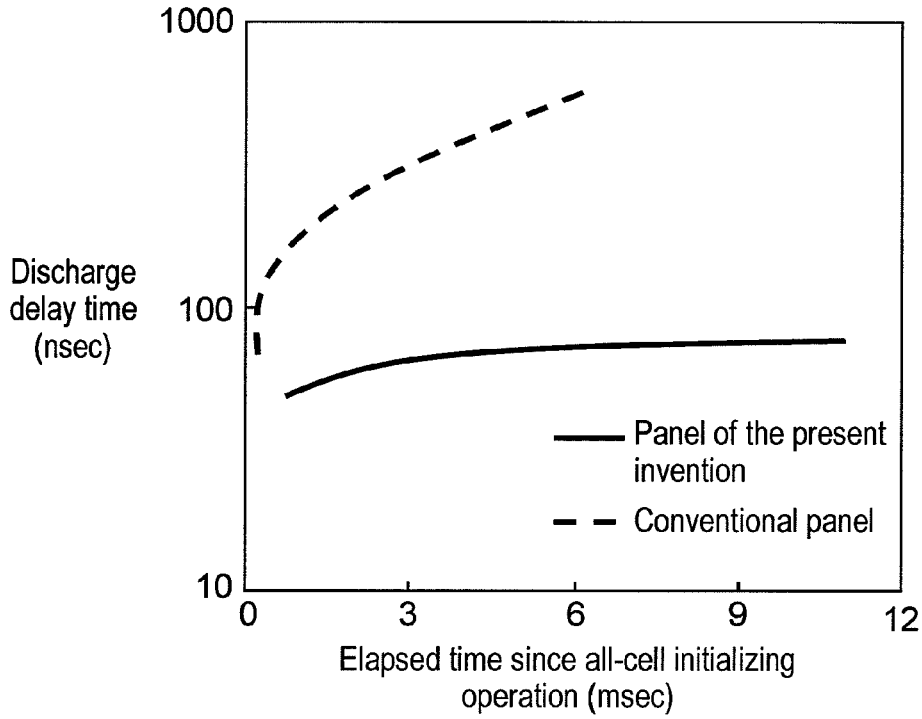
FIG. 8A shows the relation between the discharge delay time of the panel and a lapse of time since the completion of an all-cell initializing operation.
Figure 8B:
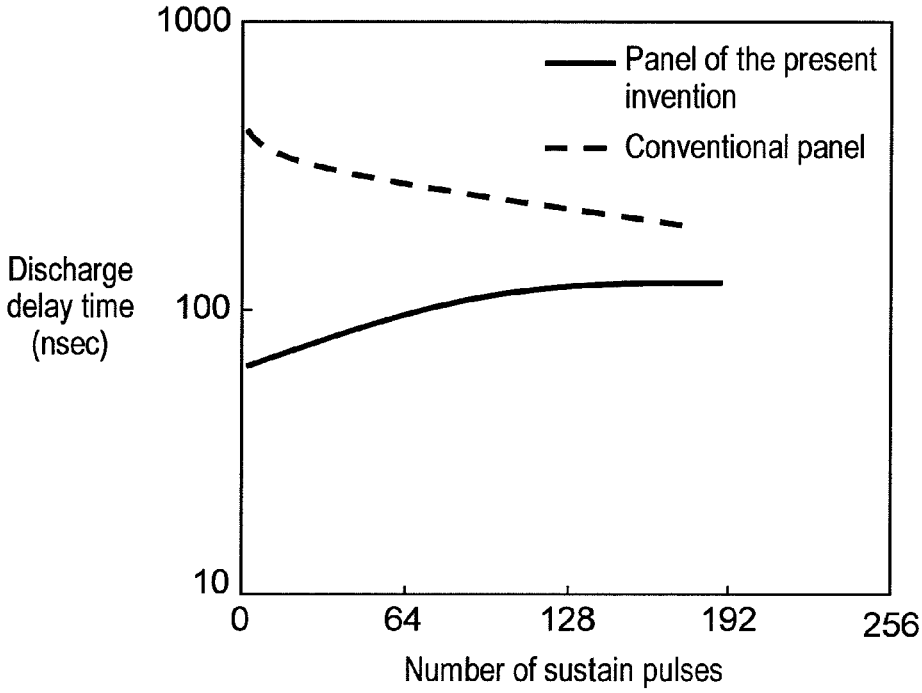
FIG. 8B shows the relation between the discharge delay time and the number of sustain pulses of the panel.

FIG. 8A shows the relation between the discharge delay time and a lapse of time since the all-cell initializing operation in panel 10 in accordance with the exemplary embodiment of the present invention. FIG. 8B shows the relation between the discharge delay time and the number of sustain pulses in accordance with the exemplary embodiment of the present invention. For comparison, FIGS. 8A and 8B show the characteristic of the conventional panel with a broken line.

As is apparent from the drawings, compared to the conventional panel, panel 10 of the embodiment has an extremely shortened discharge delay time. High electron emission performance of panel 10 of the embodiment contributes to the shortened discharge delay time. As is shown in FIG. 8A, panel 10 of the embodiment has a tendency that the discharge delay time becomes long with increase in a lapse of time since the all-cell initializing operation. This is true also in the conventional panel. It is considered that the priming generated in the all-cell initializing operation decreases with time, which suppresses the generation of discharge.

On the other hand, in terms of the relation between the discharge delay time and the number of sustain pulses, as is shown in FIG. 8, the conventional panel has a tendency that the discharge delay time decreases as the number of sustain pulses increases. In contrast, panel 10 of the embodiment has a tendency that the discharge delay time increases as the number of sustain pulses increases. The general view is that increase in the number of sustain pulses promotes priming following a sustain discharge, decreasing the discharge delay time. However, panel 10 of the embodiment shows the opposite tendency. Although the reason why such a tendency appears in panel 10 of the embodiment is not fully clarified, the following can be one possibility. That is, of a formative delay time and a statistical delay time that determine the discharge delay time, the statistical delay time that is significantly affected by the priming is sufficiently short, so that the priming following the sustain discharge does not largely contribute to the discharge delay time. Panel 10 of the embodiment has charge retention performance higher than that of the conventional panel, but the wall charge reduces slightly. Therefore, the wall charge reduces in response to the sustain discharge, the voltage substantially applied between the electrodes decreases, increasing the formative delay time, and as a result, the discharge delay time increases.

In a panel of low electron emission performance, the influence of the priming on the statistical delay time sometimes extends to a range from 100 to 1000 ns, whereas the influence of the decrease in wall voltage on the formative delay time is relatively small, for example, around 100 ns. That is, in the panel of low electron emission performance, the influence of the priming on the statistical delay time is stronger, and the discharge delay time decreases with increase in the number of sustain pulses. In contrast, in panel 10 of high electron emission performance, the influence of the priming on the discharge delay is small, and the influence of the decrease in wall voltage on the statistical delay time is strong even when the charge retention performance is high. As a result, the discharge delay time increases with increase in the number of sustain pulses.

Thus, panel 10 of the embodiment has tendencies that increase in the number of sustain pulses increases the discharge delay time, and increase in the lapse of time since the all-cell initializing operation increases the discharge delay time. Therefore, employing the subfield structure of descending coding—where an increased number of the sustain pulses is used when the lapse of time since the all-cell initializing operation is small and a decreased number of the sustain pulses is used when the lapse of time since the all-cell initializing operation is large—allows the conditions of extending/shortening the discharge delay time to be cancelled out with each other. As a result, the plasma display device achieves high-speed driving, taking full advantage of panel 10 of the embodiment.

Figure 9:
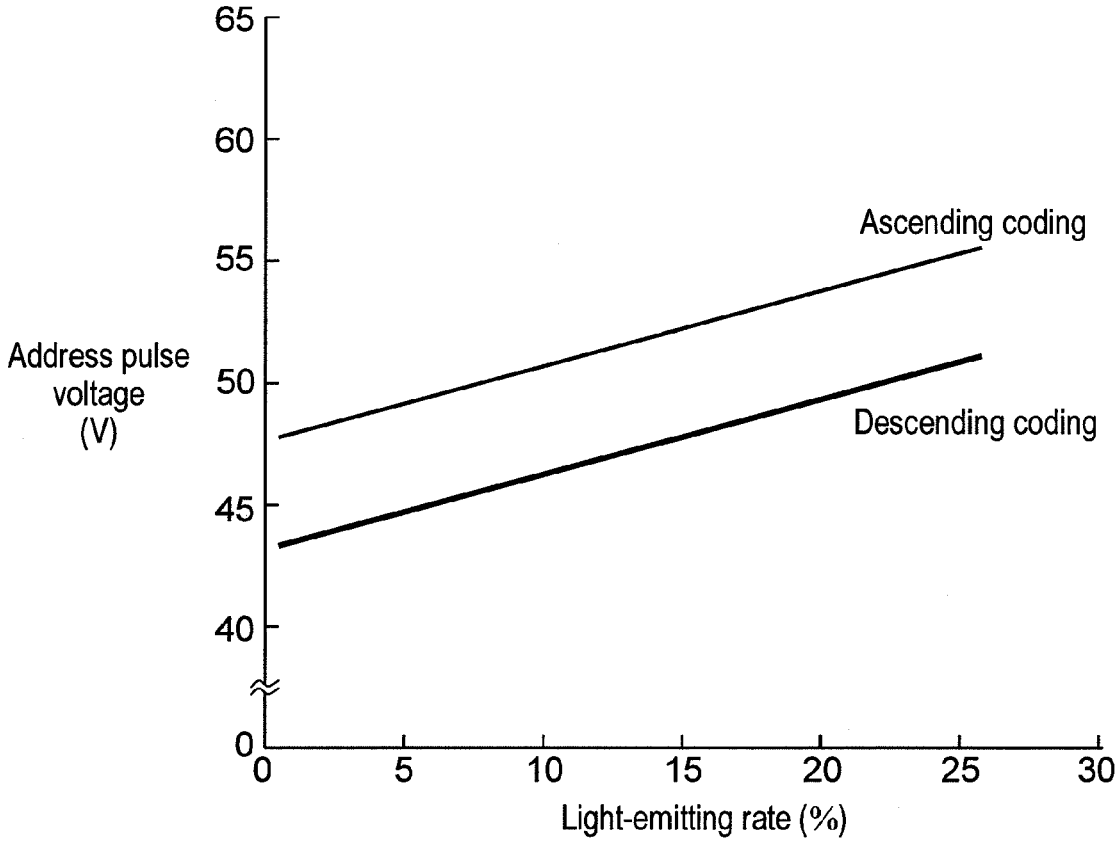
FIG. 9 shows in minimum voltage applied to the data electrodes when a panel is driven with a subfield structure of descending coding and when a panel is driven with a subfield structure of ascending coding.
Figure 10:
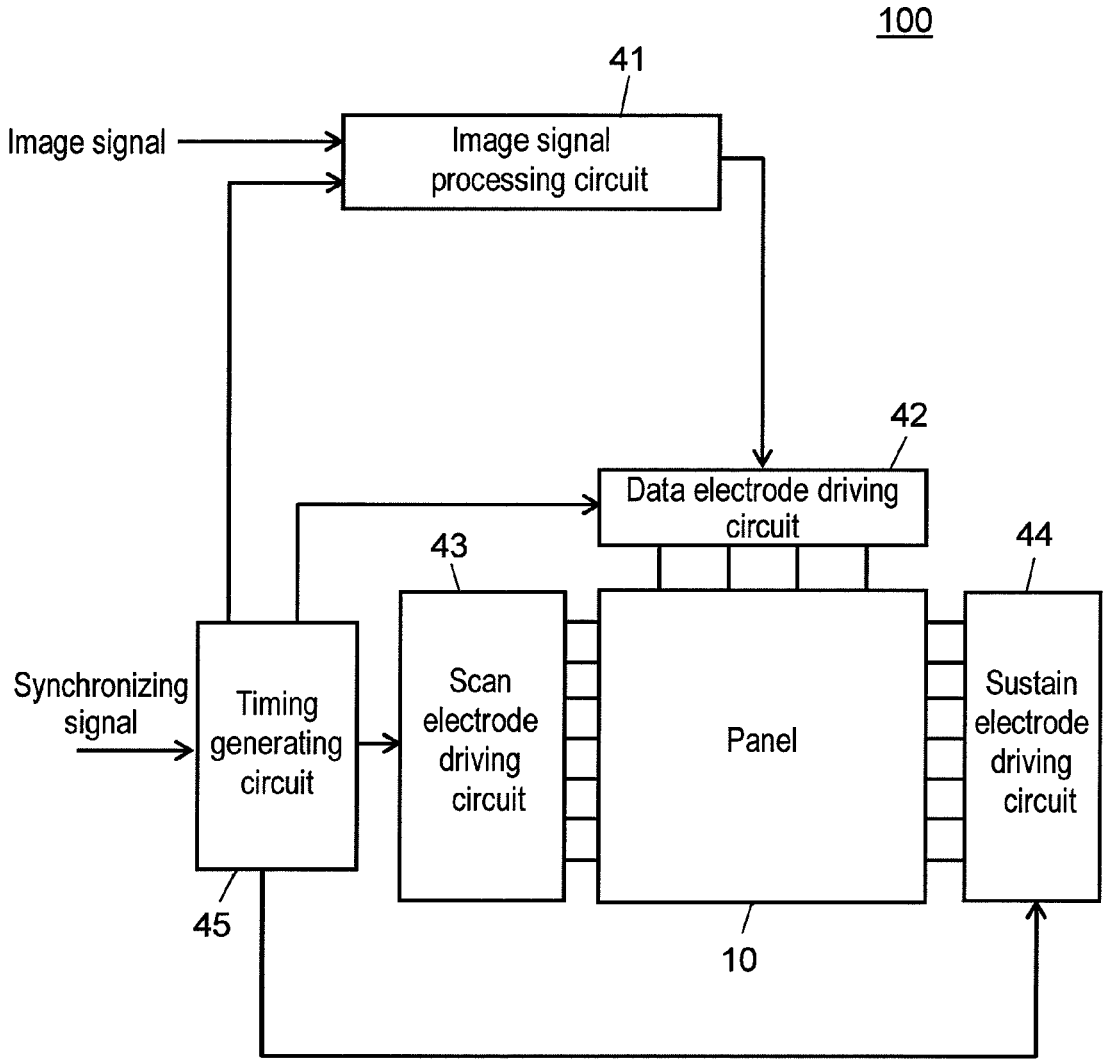
FIG. 10 is a circuit block diagram of a plasma display device in accordance with the exemplary embodiment of the present invention.

In addition, the subfield structure of descending coding reduces the voltage applied to data electrodes D1 through Dm. FIG. 9 is a diagram showing the lowest voltages applied to data electrodes D1 through Dm when panel 10 of the embodiment is driven with a subfield structure of descending coding where subfields are disposed so that the luminance weight monotonically decreases and when panel 10 is driven with a subfield structure of ascending coding where subfields are disposed so that the luminance weight monotonically increases. According to FIG. 9, the required address pulse voltage increases in response to increase in light-emitting rate, but employing the subfield structure of descending coding decreases address pulse voltage Vd by about 5(V). This reduces the electric power of the data electrode driving circuit.

Next will be described an example of the panel driving circuits for generating the aforementioned driving voltage.

Figure 11:
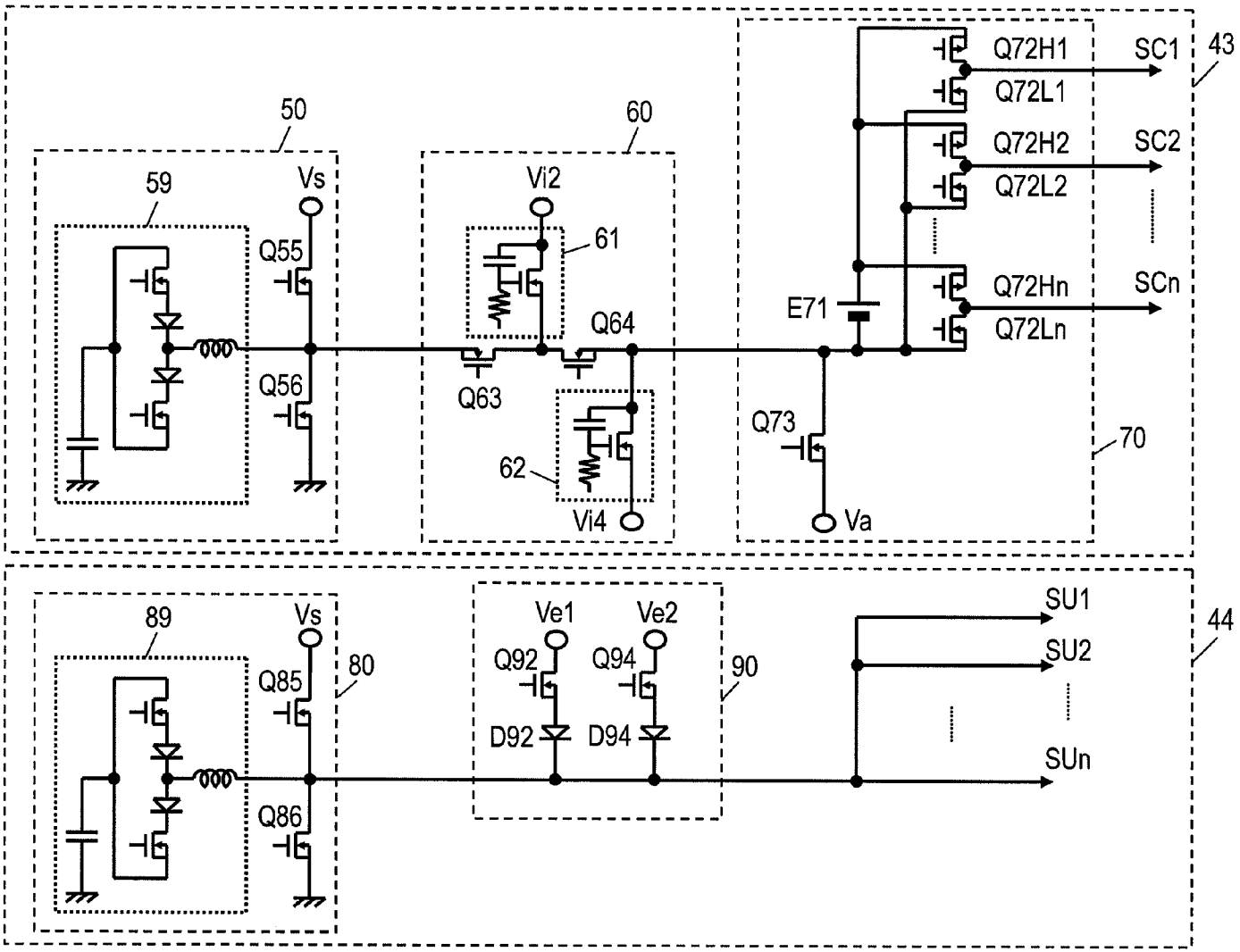
FIG. 11 is a circuit diagram showing the scan electrode driving circuit and the sustain electrode driving circuit of the plasma display device.

FIG. 11 is a circuit block diagram of plasma display device 100 in accordance with the exemplary embodiment of the present invention. Plasma display device 100 has panel 10 and a panel driving circuit. Protective layer 26 of panel 10 is formed of base protective layer 26*a* and particle layer 26*b*. Base protective layer 26*a* is formed of a thin film of metal oxide containing at least one of magnesium oxide, strontium oxide, calcium oxide, and barium oxide. Particle layer 26*b* is formed in a manner that magnesium oxide single-crystal particle 27, which has the peak of emission intensity at 200-300 nm being twice or greater than the peak of emission intensity at 300-550 nm, are stuck onto base protective layer 26*b*. The panel driving circuit drives the plasma display panel in a manner that an initializing period has one of the all-cell initializing operation for generating an initializing discharge in all discharge cells and the selective initializing operation for generating an initializing discharge in a discharge cell having undergone a sustain discharge before the all-cell initializing operation, and the subfields are temporally disposed so that the luminance weight monotonically decreases from a subfield where the all-cell initializing operation is performed to a subfield where the next all-cell initializing operation is performed. The panel driving circuit has image signal processing circuit 41, data electrode driving circuit 42, scan electrode driving circuit 43, sustain electrode driving circuit 44, timing generating circuit 45, and a power supply circuit (not shown) for supplying power to each circuit block. Receiving an image signal, image signal processing circuit 41 converts it into image data for light-emitting or non-light-emitting on a subfield basis. Data electrode driving circuit 42 converts the image data of each subfield into a signal for data electrodes D1 through Dm to drive them. Timing generating circuit 45 generates timing signals that control each circuit block according to a horizontal synchronizing signal and a vertical synchronizing signal. Such generated timing signals are fed to each circuit block. According to the timing signals, scan electrode driving circuit 43 drives scan electrodes SC1 through SCn. According to the timing signals, sustain electrode driving circuit 44 drives sustain electrodes SU1 through SUn.

FIG. 11 is a circuit diagram showing scan electrode driving circuit 43 and sustain electrode driving circuit 44 of plasma display device 100 of the embodiment of the present invention.

Scan electrode driving circuit 43 has sustain pulse generating circuit 50, initializing waveform generating circuit 60, and scan pulse generating circuit 70. Sustain pulse generating circuit 50 has switching element Q55 for applying voltage Vs to scan electrodes SC1 through SCn, switching element Q56 for applying 0 (V) to scan electrodes SC1 through SCn, and power recovering section 59 for recovering power for the application of sustain pulses to scan electrodes SC1 through SCn. Initializing waveform generating circuit 60 has Miller integrating circuit 61 and Miller integrating circuit 62. Miller integrating circuit 61 applies voltage having up-ramp waveform to scan electrodes SC1 through SCn, whereas Miller integrating circuit 62 applies voltage having down-ramp waveform to scan electrodes SC1 through SCn. Switching elements Q63, Q64 prevent backflow of electric current via a parasitic diode of other switching elements. Scan pulse generating circuit 70 has floating power supply E71, switching elements Q72H1 through Q72Hn and Q72L1 through Q72Ln, and switching element Q73. Switching elements Q72H1 through Q72Hn apply voltage on the high-voltage side of floating power supply E71 to scan electrodes SC1 through SCn, whereas switching elements Q72L1 through Q72Ln apply voltage on the low-voltage side of floating power supply E71 to scan electrodes SC1 through SCn. Switching element Q73 fixes voltage on the low-voltage side of floating power supply E71 to voltage Va.

Sustain electrode driving circuit 44 has sustain pulse generating circuit 80 and initializing/address voltage generating circuit 90. Sustain pulse generating circuit 80 has switching element Q85 for applying voltage Vs to sustain electrodes SU1 through SUn, switching element Q86 for applying 0 (V) to sustain electrodes SU1 through SUn, and power recovering section 89 for recovering power for the application of sustain pulses to sustain electrodes SU1 through SUn. Initializing/address voltage generating circuit 90 has switching element Q92 and diode D92 for applying voltage Ve1 to sustain electrodes SU1 through SUn, switching element Q94 and diode D94 for applying voltage Ve2 to sustain electrodes SU1 through SUn.

The switching elements above are formed of generally well-known devices, such as a metal oxide semiconductor field-effect transistor (MOSFET) and an insulated gate bipolar transistor (IGBT). The switching elements are controlled by each of timing signals generated in timing generating circuit 45.

The driving circuit of FIG. 11 is introduced as an example for generating the driving voltage waveforms shown in FIG. 6. The plasma display device of the present invention does not necessarily have the circuit structure.

Figure 12:
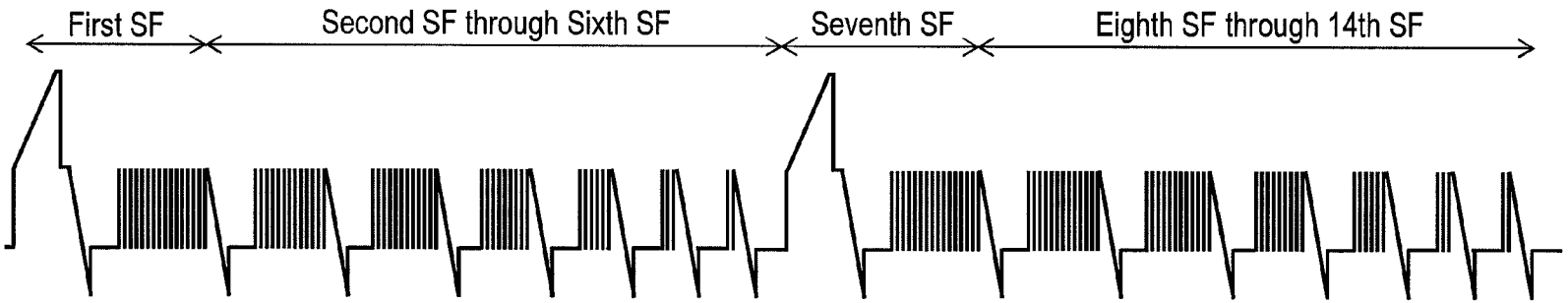
FIG. 12 shows a subfield structure in accordance with another exemplary embodiment of the present invention.

In the embodiment, one field is divided into 10 subfields, and only the first SF is an all-cell initializing subfield. The present invention is not limited to this. FIG. 12 is a diagram showing a subfield structure in accordance with another exemplary embodiment of the present invention. The subfield structure of FIG. 12 has the following conditions:

one field is divided into 14 subfields; and the first SF and the seventh SF are all-cell initializing subfields;

the luminance weight monotonically decreases between the first SF and the sixth SF, and between the seventh SF and the 14th SF.

It is important that the luminance weight monotonically decreases from an all-cell initializing subfield to the subfield immediately before the next all-cell initializing subfield. The number of subfields forming one period, the subfields for all-cell initializing operation and the number of the subfields may be arbitrarily determined as required.

Besides, specific values seen throughout the description of the embodiment are cited merely by way of example and without limitation. They should be optimally determined according to characteristics of a panel and specifications of a plasma display device.

Industrial Applicability

The plasma display device of the present invention offers stable address operation at high speed and image display with high quality.

Therefore, the plasma display device is useful for a display device.

The invention claimed is:

1. A plasma display device comprising:

a plasma display panel including a front plate including a first glass substrate on which display electrode pairs are formed, a dielectric layer covering the display electrode pairs, and a protective layer formed on the dielectric layer, the display electrode pairs including a scan electrode and a sustain electrode, a back plate disposed facing the front plate, the back plate including a second glass substrate on which data electrodes are formed such that the data electrodes of the back plate are facing the display electrode pairs of the front plate, and discharge cells formed at intersecting positions of the display electrode pairs and the data electrodes; and a panel driving circuit for driving the plasma display panel, such that a plurality of subfields are temporally disposed to form one field period, each subfield of the plurality of subfields having an initializing period for generating an initializing discharge, an address period for generating an address discharge, and a sustain period for generating a sustain discharge in the discharge cells, wherein the protective layer includes:

a base protective layer formed of a thin film of metal oxide containing at least one of magnesium oxide, strontium oxide, calcium oxide, and barium oxide; and a particle layer formed such that a plurality of single-crystal particles of magnesium oxide, having a peak of emission intensity at 200-300 nm or higher than two times another peak of emission intensity at 300-550 nm in an emission spectrum in a cathode luminescence emission, are stuck on the base protective layer, wherein the panel driving circuit is configured to drive the plasma display panel such that the initializing period of a subfield of the plurality of subfields has one of (i) an all-cell initializing operation generating an initializing discharge in all of the discharge cells and (ii) a selective initializing operation generating an initializing discharge in a discharge cell having undergone a sustain discharge before the all-cell initializing operation, wherein the plurality of subfields are temporally disposed such that a magnitude of luminance weight monotonically decreases from (i) a subfield in which the all-cell initializing operation is performed to (ii) a subfield in which a next all-cell initializing operation is performed, wherein while the panel driving circuit performs the all-cell initializing operation, a gradually increasing ramp waveform voltage is applied to the scan electrode, and then a gradually decreasing ramp waveform voltage is applied to the scan electrode, wherein while the panel driving circuit performs the selective initializing operation, a gradually decreasing ramp waveform voltage is applied to the scan electrode, and wherein the plasma display panel has a property, as measured when an address operation is carried out only in the fifth sub-field and the number of sustain pulses in the subsequent sustain period is varied from 2 to 256, that a discharge delay time related to a sub-field increases as the number of sustain pulses in the sub-field increases, and wherein a discharge delay time of an address discharge related to a sub-field increases as an elapsed time since an all-cell initializing operation is performed in the sub-filed increases.

2. The plasma display device of claim 1, wherein the particle layer is a fired product of a magnesium oxide precursor.

3. The plasma display device of claim 1, wherein the plurality of single-crystal particles are stuck on the base protective layer according to an island-shaped distribution and having a covering ratio of 1% to 30%.

* * * * *